US005438835A

United States Patent [19]

Rathbone

[11] Patent Number: 5,438,835

[45] Date of Patent: Aug. 8, 1995

[54] AIR SEPARATION

[75] Inventor: Thomas Rathbone, Farnham, England

[73] Assignee: The BOC Group plc, Windlesham, United Kingdom

[21] Appl. No.: 230,667

[22] Filed: Apr. 21, 1994

[30] Foreign Application Priority Data

Jul. 5, 1993 [GB] United Kingdom ..... 9313839
Mar. 16, 1994 [GB] United Kingdom ..... 9405071

[51] Int. Cl.[6] ..... F25J 3/02
[52] U.S. Cl. ..... 62/25; 62/38
[58] Field of Search ..... 62/24, 25, 38

[56] References Cited

U.S. PATENT DOCUMENTS 5,233,838 1/1993 Howard ..... 62/25
5,235,816 8/1993 Parsnick et al. ..... 62/38
5,245,832 9/1993 Roberts ..... 62/24
5,263,327 11/1993 Drnevich et al. ..... 62/24
5,265,429 11/1993 Dray ..... 62/25

FOREIGN PATENT DOCUMENTS 2057660 4/1981 United Kingdom .

*Primary Examiner*—Ronald C. Capossela

*Attorney, Agent, or Firm*—David M. Rosenblum; Larry R. Cassett

[57] ABSTRACT

A first stream of cooled and purified air is introduced into a higher pressure rectification column 12 through an inlet 14 and is separated into oxygen-enriched liquid and nitrogen vapour. A stream of the oxygen-enriched liquid is flashed through a pressure reducing valve 40 into an intermediate rectification column 22 in which it is separated into further-enriched liquid and an intermediate nitrogen vapour. A stream of the further-enriched liquid is reboiled in condenser-reboiler 46 and is introduced into a lower pressure rectifier 34 comprising an upper stage 58 and a lower stage 60. The lower pressure rectifier 34 has a bottom condenser-reboiler 16 which is heated by a second stream of cooled and purified air. The second stream is itself condensed in the reboiler 16 and is introduced into the higher pressure column 12. The lower pressure rectifier also has an intermediate condenser-reboiler 22 which is employed to form liquid nitrogen reflux for the rectification by condensing nitrogen vapour separated in the higher pressure rectification column. In alternative examples of the process, the liquid that is flashed through the valve 40 is subjected to phase separation rather than rectification.

18 Claims, 8 Drawing Sheets

AIR SEPARATION

BACKGROUND OF INVENTION

This invention relates to a method and apparatus for separating air.

The most important method commercially of separating air is by rectification. The most frequently used air separation cycles include the steps of compressing a stream of air, purifying the resulting stream of compressed air by removing water vapour and carbon dioxide, and pre-cooling the stream of compressed air by heat exchange with returning product streams to a temperature suitable for its rectification. The rectification is performed in a so-called "double rectification column" comprising a higher pressure and a lower pressure rectification column i.e. one of the two columns operates at higher pressure than the other. Most if not all of the air is introduced into the higher pressure column and is separated into oxygen-enriched liquid air and liquid nitrogen vapour. The nitrogen vapour is condensed. A part of the condensate is used as liquid reflux in the higher pressure column. Oxygen-enriched liquid is withdrawn from the bottom of the higher pressure column, is sub-cooled, and is introduced into an intermediate region of the lower pressure column through a throttling or pressure reduction valve. The oxygen-enriched liquid is separated into substantially pure oxygen and nitrogen products in the lower pressure column. These products are withdrawn in the vapour state from the lower pressure column and form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, the lower pressure column is operated at pressures in the range of 1 to 1.5 atmospheres absolute. Liquid oxygen at the bottom of the lower pressure column is used to meet the condensation duty at the top of the higher pressure column. Accordingly, nitrogen vapour from the top of higher pressure column is heat exchanged with liquid oxygen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed are arranged to be such that the temperature of the condensing nitrogen is a degree or two Kelvin higher than that of the boiling oxygen in the lower pressure column. In consequence of these relationships, it is not generally possible to operate the higher pressure column below a pressure of about 5 bar.

Improvements to the air separation process enabling the higher pressure column to be operated at a pressure below 5 bar have been proposed when the oxygen product is not of high purity, containing, say, from 3 to 20% by volume of impurities. U.S. Pat. No. 4,410,343 (Ziemer) discloses that when such lower purity oxygen is required, rather than having the above-described link between the lower and higher pressure columns, air is employed to boil oxygen in the bottom of the lower pressure column in order both to provide reboil for that column and to evaporate the oxygen product. The resulting condensed air is then fed into both the higher pressure and the lower pressure columns. A stream of oxygen-enriched liquid is withdrawn from the higher pressure column, is passed through a throttling valve and a part of it is used to perform the nitrogen condensing duty at the top of the higher pressure column.

U.S. Pat. No. 3,210,951 also discloses a process for producing impure oxygen in which air is employed to boil oxygen in the bottom of the lower pressure column in order both to provide reboil for that column and to evaporate the oxygen product. In this instance, however, oxygen-enriched liquid from an intermediate region of the lower pressure column is used to fulfil the duty of condensing nitrogen vapour produced in the higher pressure column. This process is capable of reducing the operating pressure of the higher pressure column close to 4 bar.

The methods disclosed in U.S. Pat. No. 3,210,951 and U.S. Pat. No. 410,343 become less suitable for use if the lower pressure column is to be operated at a pressure in excess of about 1.5 bar. EP-A-0 538 118 discloses a method of operating a double column process above the conventional pressure limits without loss of oxygen recovery and with improvements in power consumption. In one example, oxygen-enriched liquid air is taken from the bottom of the higher pressure rectification column and is introduced into a further column at a level above all the liquid-vapour mass exchange surfaces therein. The further column operates at pressures intermediate those in the higher pressure column and those in the lower pressure column. The further column provides a liquid feed and a vapour feed to intermediate levels of the lower pressure rectification column.

It is an aim of the present invention to provide air separation methods and apparatuses which are operable more efficiently at elevated lower pressure rectifier pressures than are the above described prior art processes.

SUMMARY OF THE INVENTION

According to the present invention there is provided a method of separating air, comprising the steps of:

a) separating pre-cooled and purified air in a higher pressure rectifier into oxygen-enriched liquid and nitrogen vapour;

b) separating a stream of the oxygen-enriched liquid at a pressure between the pressure at the top of the higher pressure rectifier and that at the bottom of a lower pressure rectifier so as to form a liquid further enriched in oxygen and an intermediate vapour;

c) separating a stream of the further-enriched liquid in the lower pressure rectifier into oxygen and nitrogen; and d) providing liquid nitrogen reflux for the higher and lower pressure rectifiers, wherein a part of the liquid nitrogen reflux is formed by condensing a stream of said nitrogen vapour by indirect heat exchange with liquid from an intermediate mass transfer region of the lower pressure rectifier.

The invention also provides apparatus for separating air, comprising:

a) a higher pressure rectifier for separating pre-cooled and purified air into oxygen-enriched liquid and nitrogen vapour;

b) a lower pressure rectifier for producing oxygen and nitrogen;

c) means for separating a stream of the oxygen-enriched liquid at a pressure between the pressure at the top of the higher pressure rectifier and that at the bottom of the lower pressure rectifier so as to form a liquid further enriched in oxygen and an intermediate vapour;

d) means for introducing a stream of the further-enriched liquid into the lower pressure rectifier for separation into oxygen and nitrogen; and e) means for providing liquid nitrogen reflux for the higher and lower pressure rectifiers including a condenser for indirectly heat exchanging a stream of said nitrogen vapour with liquid from an intermediate mass transfer region of the lower pressure rectifier.

The separation of the stream of the said oxygen enriched liquid in step (b) of the method according to the invention is performed either by (i) rectification in a further rectifier (sometimes referred to hereinafter as "intermediate rectification") or by (ii) flashing the stream of oxygen-enriched liquid to form a liquid-vapour mixture at said pressure between the pressure at the top of the higher pressure rectifier and that at the bottom of the lower pressure rectifier; and separating the resulting liquid-vapour mixture into liquid and vapour phases to form the further enriched liquid and the intermediate vapour, these steps sometimes being referred to collectively as "intermediate flash separation". In order to enhance the rate of formation of the intermediate vapour a part of the further enriched liquid is preferably reboiled.

If step (b) of the method according to the invention is performed by intermediate rectification, the stream of oxygen-enriched liquid is introduced below all liquid-vapour mass exchange means in the further rectifier or the incoming feed to it.

Reboiling of this liquid is preferably performed by indirect heat exchange with another stream of nitrogen from the higher pressure rectifier, the nitrogen thereby being condensed. The nitrogen condensate provides a further source of reflux which is preferably employed in the higher pressure rectifier. The further rectifier is preferably provided with a reboiler so as partially to reboil liquid at the bottom of the further rectifier. The further rectifier preferably produces, as the intermediate vapour, nitrogen. The nitrogen is preferably condensed to form yet further liquid nitrogen reflux, a part of which is preferably used in the lower pressure rectifier and another part of which is preferably used in the further rectifier.

If step (b) of the method according to the invention is performed by intermediate flash separation, the partial reboiling may be performed upstream of or in the phase separator. The partial reboiling may be performed by indirect heat exchange with another stream of nitrogen vapour from the higher pressure rectifier, the nitrogen thereby being condensed. The nitrogen condensate provides a further source of reflux which is preferably employed in the higher pressure rectifier. Yet further liquid nitrogen reflux is preferably formed by indirect heat exchange of nitrogen from the higher pressure rectifier with liquid oxygen withdrawn from a bottom region of the lower pressure rectifier, which liquid oxygen preferably enters into the indirect heat exchange at a pressure less than that at the top of the lower pressure rectifier. The liquid oxygen is thereby vaporised and may be taken as product. The yet further liquid nitrogen reflux is typically used as reflux in the higher pressure rectifier.

If step (b) of the method according to the invention is performed by intermediate flash separation, the said intermediate vapour is preferably condensed and the resulting condensate is preferably returned to the higher pressure rectifier, thereby enhancing the rate of production of liquid nitrogen reflux.

Irrespective of how step (b) is performed, condensation of the intermediate vapour is preferably performed by indirect heat exchange with a stream of said further-enriched liquid, which stream is reduced in pressure upstream of the heat exchange. The stream of said further-enriched liquid is typically partially vaporised thereby and the resulting fluid is preferably introduced into the lower pressure rectifier. (If desired, a stream of further-enriched liquid may be introduced into the lower pressure rectifier, by-passing the indirect heat exchange with the intermediate vapour.) Alternatively, the intermediate vapour may be condensed by indirect heat exchange with liquid taken from an intermediate mass transfer region of the lower pressure rectifier, the liquid taken from the intermediate mass transfer region of the lower pressure rectifier thereby being at least partially reboiled. It is preferably returned to a mass transfer region of the lower pressure rectifier.

Typically, reboil for the lower pressure rectifier is provided by indirect heat exchange in a reboiler-condenser with a stream of pre-cooled and purified feed air, the feed air stream thereby being at least partially condensed.

The higher pressure rectifier and further rectifier preferably each comprise a rectification column. The lower pressure rectifier may also comprise a single rectification column or may comprise two separate columns. The latter arrangement offers the advantage that the said condenser for indirectly heat exchanging a stream of said nitrogen vapour with liquid from an intermediate mass transfer region of the lower pressure rectifier may be located in a bottom region of one column and may therefore be a condenser-reboiler of the conventional thermo-siphon kind.

The oxygen separated in the lower pressure rectifier is preferably from 85 to 96% pure. The nitrogen separated in the lower pressure rectifier is preferably at least 98% pure.

Refrigeration for the method according to the invention may be created by expansion with the performance of external work of a stream of either the feed air or a nitrogen stream.

BRIEF DESCRIPTION OF THE DRAWINGS

The method and apparatus according to the invention will now be described by way of example with reference to the accompanying drawings, in which.

Figure 1:
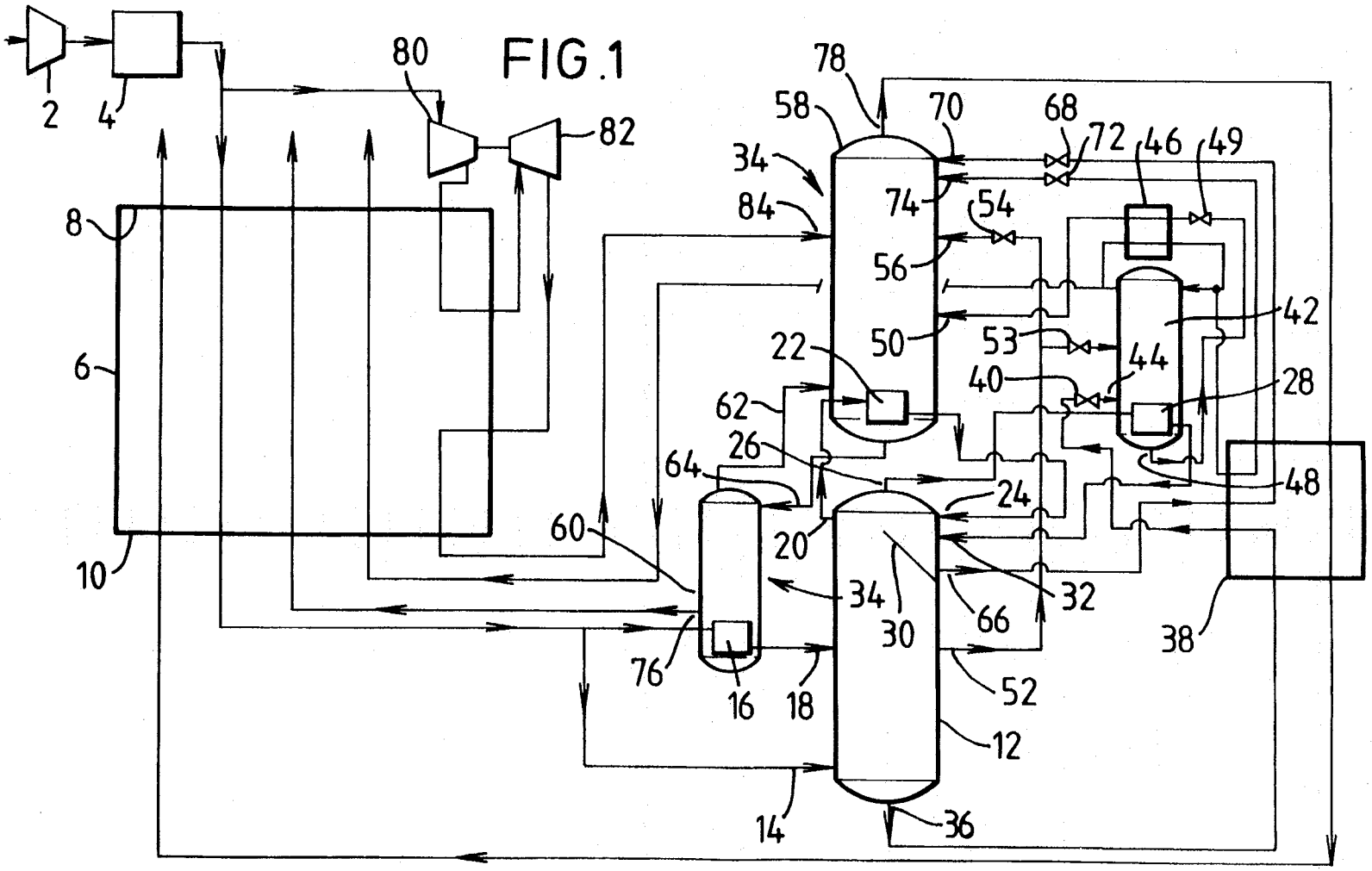
FIG. 1 is a schematic flow diagram of a first air separation plant according to the invention.

In the ensuing description of FIG. 1, parameters set out in square brackets are those obtained in a computer simulation of the operation of the plant depicted therein.

DETAILED DESCRIPTION

Referring to FIG. 1 of the drawings, a feed air stream is compressed in a compressor 2 and the resulting compressed feed air stream is passed through a purification unit 4 effective to remove water vapour and carbon dioxide therefrom.

The unit 4 employs beds (not shown) of adsorbent to effect this removal of water vapour and carbon dioxide. The beds are operated out of sequence with one another such that while one or more beds are purifying the feed air stream the remainder are being regenerated, for example by being purged with a stream of hot nitrogen. Such a purification unit and its operation are well known in the art and need not be described further.

The purified feed air stream [temperature, 297K; pressure, 12.3 bar] is divided into first and second air streams. The first air stream [flow rate—95823 $sm^3/hr$] flows through a main heat exchanger 6 from its warm end 8 to its cold end 10 and is thereby cooled from about ambient temperature to its saturation temperature (or other temperature suitable for its separation by rectification) [116.9K]. A first part of the cooled first air stream [flow rate—51082 $sm^3/hr$] is introduced into a bottom region of a higher pressure rectification column 12 through an inlet 14. A second part of the first cooled air stream [flow rate—44741 $sm^3/hr$] is at least partially condensed by passage through the condensing passages of a first condenser-reboiler 16. The resulting at least partially condensed air [state—100% liquid; temperature—109.3K] is introduced into the higher pressure rectification column 12 through an inlet 18. The higher pressure rectification column 12 contains liquid-vapour contact means (not shown) whereby a descending liquid phase is brought into intimate contact with an ascending vapour phase such that mass transfer between the two phases takes place.

The descending liquid phase becomes progressively richer in oxygen and the ascending vapour phase progressively richer in nitrogen. The liquid-vapour contact means may comprise an arrangement of liquid-vapour contact trays and associated downcomers or may comprise a structured or random packing. A volume (not shown) of liquid typically collects at the bottom of the higher pressure rectification column 12.

The inlet 14 is typically located so that the air is introduced into the column 12 below the liquid-vapour contact means or otherwise such that the liquid at the bottom of the higher pressure rectification column 12 is approximately in equilibrium with the incoming air. Accordingly, since oxygen is less volatile than the other main components (nitrogen and argon) of the air, the liquid collecting at the bottom of the higher pressure rectification column 12 (typically in a sump) has an oxygen concentration greater than that of air, i.e. is enriched in oxygen.

A sufficient number of trays or a sufficient height of packing is included in the liquid-vapour contact means (not shown) for the vapour fraction passing out of the top of the liquid-vapour contact means to be essentially pure nitrogen. A first stream of the nitrogen vapour is withdrawn from the top of the higher pressure rectification column 12 through an outlet 20 and is condensed in a second reboiler-condenser 22. The condensate is returned to a collector 30 at the top of the higher pressure rectification column 12 through an inlet 24. A second stream of the nitrogen vapour is withdrawn from the top of the higher pressure rectification column 12 through an outlet 26 and is condensed in a third condenser-reboiler 28. The condensate is returned from the condenser-reboiler 28 to the collector 30 via an inlet 32. A part of the liquid nitrogen entering the collector 30 is used as liquid nitrogen reflux in the higher pressure rectification column 12; another part of the condensate is, as will be described below, used as liquid reflux in a lower pressure rectifier 34.

A stream of oxygen-enriched liquid (typically containing about 32% by volume of oxygen) [composition (mole fractions) 0.32 $O_2$; 0.01 Ar; 0.67 $N_2$; pressure—12 bar; temperature —110.7K; flow rate—44519 $sm^3/hr$] is withdrawn from the bottom of the higher pressure rectification column 12 through an outlet 36 and is sub-cooled in a heat exchanger 38. The sub-cooled oxygen-enriched liquid stream is flashed through a first pressure reducing valve 40 and a resulting mixture of a flash gas and a residual liquid further enriched in oxygen is formed. The mixture of further-enriched liquid and oxygen-depleted gas is introduced into a bottom region of an intermediate rectification column 42 through an inlet 44. Reboil for the intermediate rectification column 42 is provided by the second condenser-reboiler 28 which is situated at the bottom of the column 42. The condenser-reboiler 28 provides an upward flow of vapour from the bottom of the column 42. Another condenser-reboiler 46 condenses vapour taken from the top of the intermediate rectification column 42. A part of the resulting condensate is returned to the column 42 as reflux. Another part is used as reflux in the lower pressure rectifier 34 as will be described below. There is desirably a sufficient number of distillation trays (not shown) or a sufficient height of packing (not shown) in the intermediate rectification column 42 for the mass exchange between descending liquid and ascending vapour to produce essentially pure nitrogen at the top of the column 42. Thus the condensate formed in the condenser-reboiler 46 is essentially liquid nitrogen. If desired, a gaseous nitrogen product may also be taken from the column 42.

The condenser-reboiler 28 effects a partial reboil of liquid at the bottom of the intermediate rectification column 42. A stream of residual further-enriched liquid (typically containing about 40% by volume of oxygen) [composition (mole fractions) $O_2$—0.40; Ar—0.02; $N_2$—0.58; pressure—8.1 bar; temperature—105.4K; flow rate 38472 $sm^3/hr$] is continuously withdrawn from the bottom of the intermediate rectification column 42 through an outlet 48 and is passed through a second pressure reducing valve 49 so as to reduce its pressure to approximately the operating pressure of the lower pressure rectifier 34. A first stream of the resultant pressure-reduced further-enriched liquid (typically containing some vapour) flows through the condenser-reboiler 46, thereby providing cooling for the condensation of the nitrogen vapour therein. The stream of further-enriched liquid is itself at least partially vaporised in the condenser-reboiler 28. The resulting oxygen-enriched stream [state—66% by weight vapour; 34% by weight liquid; pressure—4.5 bar; temperature—99.1K] is introduced into the lower pressure rectifier 34 as a first feed stream at an intermediate level through an inlet 50. As a second feed stream, a stream of liquid air [composition (mole fraction) $O_2$—0.21; Ar—0.01; $N_2$—0.78; temperature—109.2K; pressure—12.0 bar; flow rate 26999 $sm^3/hr$] is withdrawn from the higher pressure rectification column 12 through an outlet 52 at the same level as that of the inlet 18. A part [flow rate 20999 $sm^3/hr$] of the second feed stream is passed through a pressure reduction valve 54 so as to reduce its pressure to approximately that of the lower pressure rectifier 34. The resulting pressure-reduced liquid air stream is introduced into the rectifier 34 through an inlet 56. In an alternative arrangement, at least partially condensed air may be supplied from the condenser-reboiler 16 to the lower pressure rectifier 34 via a pressure reducing valve (not shown) without first being introduced into the higher pressure rectification column 12. Another part [flow rate 6000 $sm^3/hr$] of the stream of liquid air withdrawn from the higher pressure rectification column 12 through the outlet 52 is taken from upstream of the valve 54 and is passed through a valve 53 into the intermediate pressure rectification column and is separated therein.

As shown in FIG. 1, the lower pressure rectifier 34 comprises an upper stage 58 and a lower stage 60. Stages 58 and 60 communicate freely with one another. That is to say vapour passes via conduit 62 from the top of the lower stage 60 to the bottom of the upper stage 58 without passing through any device to reduce or increase its pressure. Similarly, liquid flows from the bottom of the upper stage 58 into the top of the lower stage 60 via a conduit 64 without passing through any device to reduce or increase its pressure. An advantage of the two stage arrangement of the lower pressure rectifier 34 is that the condenser-reboiler 22 can be situated in a bottom region of the upper stage 58 and can therefore be of a conventional thermo-siphon kind.

Separation of the two feed streams in the lower pressure rectifier 34 results in the formation of oxygen and nitrogen products. The stages 58 and 60 of the lower pressure rectifier 34 contain liquid-vapour contact means (not shown) whereby a descending liquid phase is brought into intimate contact with an ascending vapour phase such that mass transfer between the two phases takes place. The liquid-vapour contact means (not shown) may be of the same kind as or a different kind from the liquid-vapour contact means used in the higher pressure rectification column 12 or the intermediate pressure rectification column 42. Liquid nitrogen reflux for the lower pressure rectifier 34 is provided from two sources. The first source is an outlet 66 from the collector 20 through which a stream of liquid nitrogen [mole fraction $N_2$—0.99; pressure—11.9 bar; temperature—106.6K; flow rate—24305 $sm^3/hr$] is withdrawn. The stream of liquid nitrogen is then sub-cooled by passage through the heat exchanger 38. The sub-cooled liquid nitrogen stream [temperature—94.3K; pressure—7.8 bar] passes through a pressure reducing valve 68 and flows into a top region of the upper stage 58 of the lower pressure rectifier 34 through an inlet 70. A second stream of liquid nitrogen reflux is taken from the condensate of the condenser-reboiler 46. The second stream of reflux is sub-cooled in the heat exchanger 38. The sub-cooled liquid nitrogen [mole fraction, nitrogen 1.0; temperature—94.3K; pressure—7.8 bar; flow rate 12047 $sm^3/hr$] flows through a pressure reducing valve 72 and is introduced into a top region of the upper stage 58 of the lower pressure rectifier 34 as liquid nitrogen reflux. A downward flow of liquid through the lower pressure rectifier 34 is thereby created. An upward flow of vapour through the lower pressure rectifier 34 is created by operation of the condenser-reboiler 16 to reboil liquid at the bottom of the lower stage 60 of the lower pressure rectifier 34. Flow of vapour through the upper stage 58 of the lower pressure rectifier 34 is enhanced by operation of the condenser-reboiler 22 to reboil liquid at the bottom of this stage.

An oxygen product, typically from 90 to 95% pure, [composition (mole fraction) $O_2$—0.95; Ar—0.03; $N_2$—0.02; temperature 107.3K; pressure—4.6 bar; flow rate—21525 $sm^3/hr$] is withdrawn from a bottom region of the lower stage 60 of the lower pressure rectifier 34 through an outlet 76. This product oxygen stream flows through the heat exchanger 6 from its cold end 10 to its warm end 8. It is thus warmed to ambient temperature [temperature—294K; pressure—4.4 bar]. A product nitrogen stream [composition (mole fraction) $O_2$—0.01; $N_2$—0.99; temperature—92.8K; pressure—4.5 bar; flow rate—78415 $sm^3/hr$] is withdrawn through outlet 78 from the top of the upper stage 58 of the lower pressure rectifier 34. It flows through the heat exchanger 38 thereby providing the necessary cooling for the sub-cooling of the other streams flowing therethrough. From the heat exchanger 38 the nitrogen flows through the heat exchanger 6 from its cold end 10 to its warm end 8 and leaves the heat exchanger 6 at approximately ambient temperature [temperature—294K; pressure—4.3 bar].

The refrigeration demands of the plant shown in FIG. 1 are met by taking a second stream of purified air [temperature—297K; pressure 12.3 bar; flow rate—4177 $sm^3/hr$] from the purification unit 4 and further compressing it in a compressor 80. The compressed second stream of air [temperature—297K; pressure—20.6 bar] is then cooled to a temperature intermediate those of the cold end 10 and warm end 8 of the heat exchanger 6 by passage therethrough cocurrently with the first stream of air. The second air stream is withdrawn temperature—251.6K] from an intermediate region of the main heat exchanger 6 and is expanded with the performance of external work in an expansion turbine 82. The resulting expanded stream of air [temperature—175K; pressure—4.6 bar] is returned to the heat exchanger 6 and is further reduced in temperature by passage therethrough. The expanded second stream of air passes out of the cold end 10 of the heat exchanger 6 and is introduced temperature—117.3K] into the upper stage 58 of the lower pressure rectifier 34 as a third feed stream which is separated with the other two feed streams.

Figure 2:
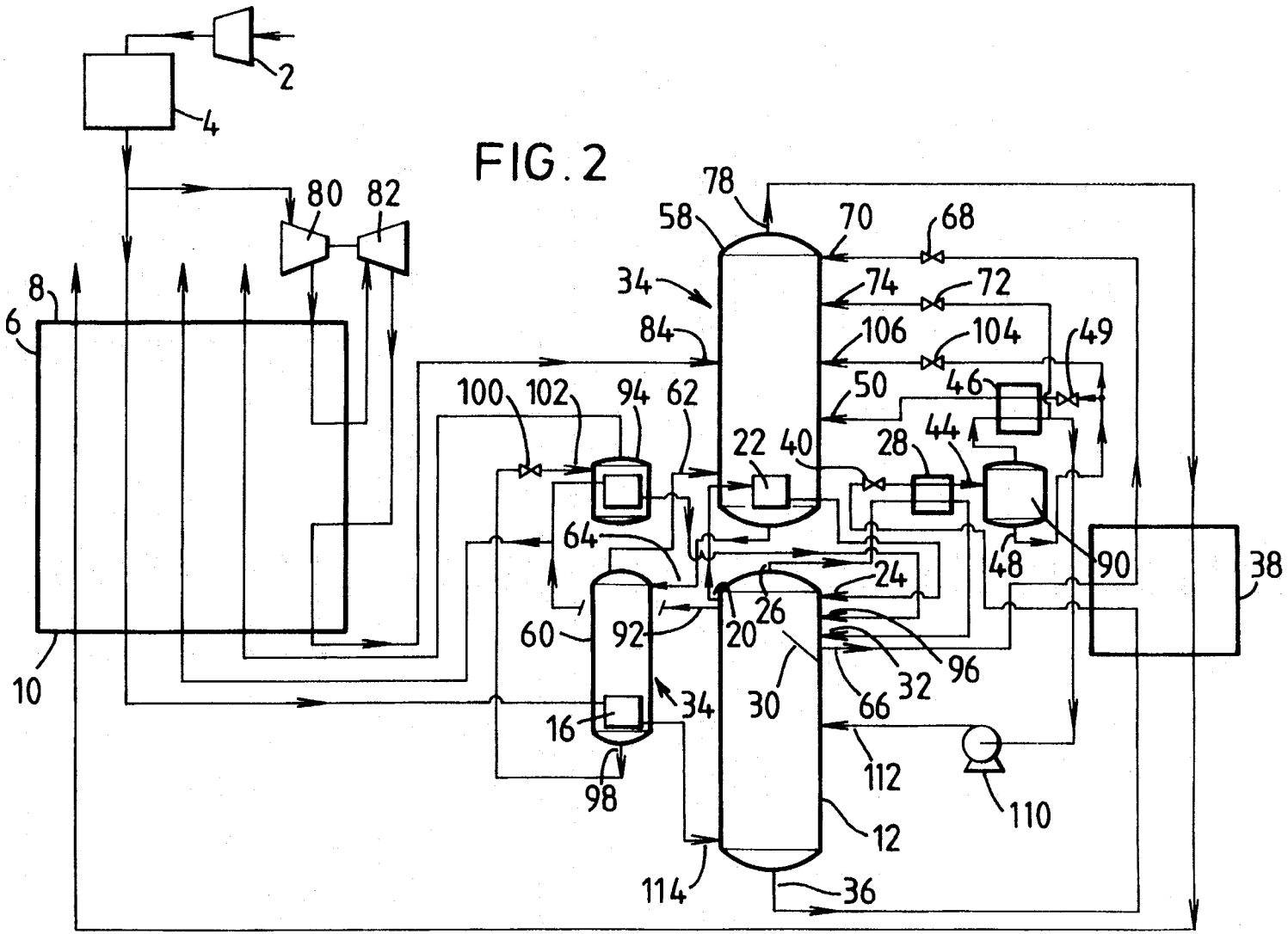
FIG. 2 is a schematic flow diagram of a second air separation plant according to the invention.

Referring now to FIG. 2 of the drawings, there is shown that the plant having a similar column arrangement to that shown in FIG. 1 save that a simple phase separator 90 (in which no rectification takes place) is substituted for the intermediate rectification column 42. As a consequence, a number of changes are made to the plant shown in FIG. 1. These changes are described below with reference to FIG. 2. First, additional reflux for the higher pressure rectification column 12 is provided by withdrawing a further stream of nitrogen vapour through an outlet 92 at a top region of the higher pressure rectification column 12 and condensing a part the stream in another condenser-reboiler 94. (Another part of the stream of nitrogen withdrawn through the outlet 92 is passed through the heat exchanger 6 from its cold end 10 to its warm end 8 and is taken as elevated pressure nitrogen product at ambient temperature). The resulting liquid nitrogen condensate is returned to the collector 30 in the higher pressure rectification column through an inlet 96. Cooling for the condenser-reboiler 94 is provided by withdrawing a stream of liquid oxygen from the bottom region of the lower stage 6 of the lower pressure rectifier 34 through an outlet 98 and flashing it through a pressure reducing valve 100 into the condenser-reboiler 94. The liquid oxygen is vaporised by heat exchange with the nitrogen from the higher pressure rectification column 12. The oxygen vapour is withdrawn from the condenser-reboiler 94 through an outlet 102 and flows through the main heat exchanger 6 from its cold end 10 to its warm end 8 as the oxygen product. Accordingly, no gaseous oxygen product stream is withdrawn directly from the lower stage 60 of the lower pressure column 34.

Another consequence of the use of phase separator 90 in the plant shown in FIG. 2 is that the vapour taken from the top of the separator 90 for condensation in the condenser-reboiler 46 contains a substantial amount of oxygen and is not suitable for use at the top of the upper stage 58 of the lower pressure rectifier 34 as liquid nitrogen reflux. Accordingly the inlet 74 is located not at a top region of the upper stage 58 of the lower pressure rectifier 34 (i.e. above the entire liquid-vapour contact means located therein) but rather at an intermediate level such that there are some liquid-vapour contact surfaces located above the level of the inlet 74. Moreover, the condensate from the condenser-reboiler 46 that is sent to the lower pressure rectifier 34 is not subcooled upstream of its passage through the pressure reducing valve 72. For a given operating pressure of the separator 90, the condenser-reboiler 46 operates at a higher temperature than it would were the vapour to be condensed therein essentially pure nitrogen. Accordingly, a part of the further-enriched liquid withdrawn through the outlet 48 of the separator 90 by-passes the pressure reducing valve 49 and the condenser-reboiler 46 in the plant shown in FIG. 2 and downstream of passage through a pressure reducing valve 104 is introduced through an inlet 106 into the upper stage 58 of the lower pressure rectifier 34 at an intermediate level thereof.

A further consequence of the use of the phase separator 90 in the plant shown in FIG. 2 is that since no rectification takes place in the separator 90, there is no need to return any of the condensate from the condenser-reboiler 46 to this separator. Instead, a portion of the condensate is urged by pump 110 into the higher pressure rectification column 12 through an inlet 112. As a result, the rate of forming liquid nitrogen in the higher pressure rectification column 12 is enhanced. Moreover, no stream of liquid air is withdrawn from an intermediate level of the rectification column 12 in order to provide feeds for the lower pressure rectifier 34 and the flash separator 90. Accordingly, the pressure reducing valves 53 and 54 and associated conduits are omitted from the plant shown in FIG. 2. An additional change is that all the first stream of feed air flows through the condenser-reboiler 16 and is introduced into the higher pressure rectification column through an inlet 114 which takes the place of the inlets 14 and 18 shown in FIG. 1.

It should also be noted that in the plant shown in FIG. 2, the condenser-reboiler is located upstream of the phase separator 90 whereby some of the liquid in the liquid-vapour mixture exiting the pressure reducing valve 40 is boiled upstream of the inlet 44 to the phase separator 90.

Based on a computer simulation, an example of the operation of the plant shown in FIG. 2 is given in Table 1 below. In this example all the nitrogen product is taken from the upper stage 58 of the lower pressure rectifier 34 and hence none from the outlet 92 of the higher pressure rectifier 12.

TABLE 1

| Description of Stream | Composition (mole fraction) O2 | Ar | N2 | state L = liquid G = Gas or vapour | Pressure/ bar | Temperature/K. | Flow rate/$sm^3$ $hr^{-1}$ |
|---|---|---|---|---|---|---|---|
| First purified air stream upstream of warm end 8 of heat exchanger 6 | 0.21 | 0.01 | 0.78 | G | 10.45 | 297.0 | 92899 |
| First purified air stream at inlet to reboiler-condenser 16 | 0.21 | 0.01 | 0.78 | G | 10.2 | 111.5 | 92899 |
| First purified air stream at inlet 114 to higher pressure rectification column 12 | 0.21 | 0.01 | 0.78 | G-0.79% L-0.21% | 10.2 | 107.9 | 92899 |
| Second purified air stream at inlet to compressor 80 | 0.21 | 0.01 | 0.78 | G | 10.45 | 297.0 | 7101 |
| Second purified air stream at outlet from compressor 80 | 0.21 | 0.01 | 0.78 | G | 15.5 | 297.0 | 7101 |
| Second purified air stream at inlet to turbine 82 | 0.21 | 0.01 | 0.78 | G | 15.4 | 208.8 | 7101 |
| Second purified air stream at outlet from turbine 82 | 0.21 | 0.01 | 0.78 | G | 4.6 | 155.0 | 7101 |
| Second purified air stream at inlet 84 to upper stage 58 of lower pressure rectifier 34 | 0.21 | 0.01 | 0.78 | G | 4.55 | 112.0 | 7101 |
| Oxygen-enriched liquid air stream at outlet 36 of higher pressure rectification column 12 | 0.31 | 0.01 | 0.68 | L | 10.2 | 107.9 | 69075 |
| Oxygen-enriched liquid air stream at inlet to pressure reducing valve 40 | 0.31 | 0.01 | 0.68 | L | 10.1 | 105.5 | 69075 |
| Further-enriched liquid stream at outlet 48 from phase separator 90 | 0.38 | 0.01 | 0.61 | L | 6.6 | 102.0 | 43520 |
| Vaporised further-enriched liquid stream at inlet 50 to upper stage 58 of lower | 0.38 | 0.01 | 0.61 | L-0.2% G-0.98% | 4.5 | 99.9 | 25078 |

TABLE 1-continued

| Description of Stream | Composition (mole fraction) O2 | Ar | N2 | state L = liquid G = Gas or vapour | Pressure/ bar | Temperature/K. | Flow rate/$sm^3$ $hr^{-1}$ |
|---|---|---|---|---|---|---|---|
| pressure rectifier 34 | | | | | | | |
| Further enriched liquid stream (part) at inlet 106 to the upper stage 58 of the lower pressure rectifier 34 | 0.38 | 0.01 | 0.61 | L | 6.6 | 102.0 | 18442 |
| Vapour flow out of separator | 0.20 | 0.01 | 0.79 | G | 6.6 | 102.0 | 25554 |
| Condensate stream at inlet to pressure reducing valve 72 | 0.20 | 0.01 | 0.79 | L | 6.6 | 99.8 | 14555 |
| Condensate stream at inlet to pump 110 | 0.20 | 0.01 | 0.79 | L | 6.6 | 99.8 | 11000 |
| Liquid nitrogen stream at outlet 66 from higher pressure rectification column 12 | <0.01 | <0.01 | 0.99 | L | 10.1 | 104.0 | 34825 |
| Liquid nitrogen stream at inlet to pressure reducing valve 68 | <0.01 | <0.01 | 0.99 | L | 9.1 | 94.3 | 34825 |
| Product nitrogen stream at outlet 78 from upper stage 58 of lower pressure rectifier 34 | 0.01 | <0.01 | 0.99 | G | 4.5 | 92.9 | 78434 |
| Product nitrogen stream at cold end 10 of heat exchanger 6 | 0.01 | <0.01 | 0.99 | G | 4.45 | 105.7 | 78434 |
| Product nitrogen stream at warm end 8 of heat exchanger 6 | 0.01 | <0.01 | 0.99 | G | 4.3 | 294.0 | 78434 |
| Oxygen stream at inlet to valve 100 | 0.95 | 0.03 | 0.02 | L | 4.6 | 106.9 | 21566 |
| Product oxygen stream at outlet 102 of condenser-reboiler 94 | 0.95 | 0.03 | 0.02 | G | 3.2 | 102.7 | 21566 |
| Product oxygen stream at warm end 8 of heat exchanger 6 | 0.95 | 0.03 | 0.02 | G | 3.1 | 294.0 | 21566 |

Note: percentages are by volume

Figure 3:
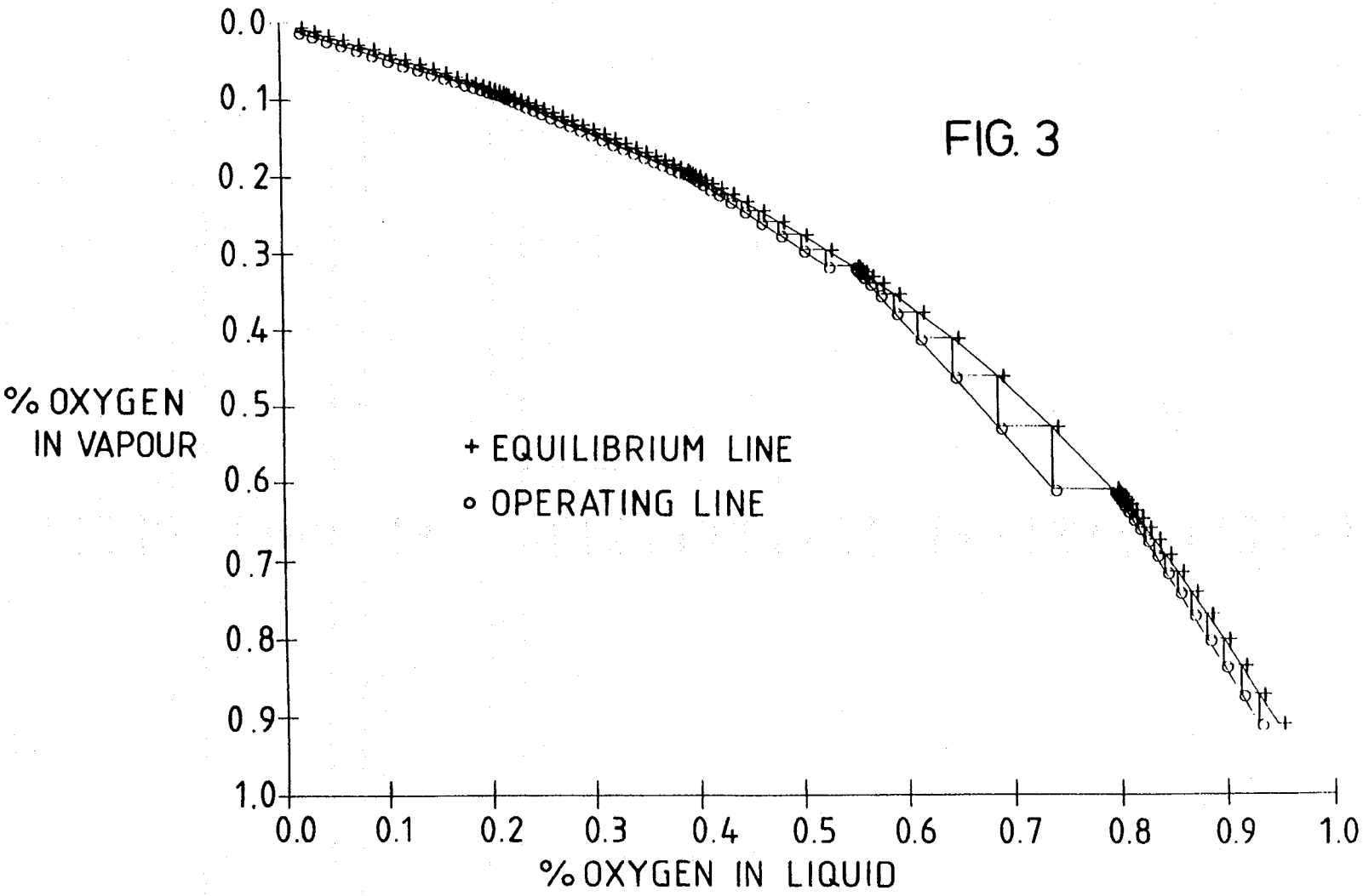
FIG. 3 is a McCabe-Thiele diagram for operation of the plant shown in FIG. 2.

Operation of the plant shown in FIG. 2 in accordance with the example set out in Table 1 is further illustrated by the McCabe-Thiele diagram (FIG. 3) which portrays the operating line for the lower pressure rectifier 34. A relatively close conformity of the operating line with the equilibrium line is achievable without employing an excessive number of theoretical plates in the lower pressure rectifier.

A comparison has been made of the operation of the plants shown in FIGS. 1 and 2 with the reported operation of a process according to EP-A-0 538 118 (see Table 1 thereof and the associated description). The results of the comparison are shown in Table 2 below.

TABLE 2

| | EP-A-538 118 | FIG. 1 | FIG. 2 |
|---|---|---|---|
| Air pressure (bar) | 16.0 | 12.33 | 10.45 |
| N2 pressure (bar) | 5.0 | 4.27 | 4.27 |
| O2 pressure (bar) | 5.16 | 4.43 | 3.07 |
| O2 Recovery % | 99.4 | 97.6 | 97.8 |
| Relative Power Consumption | 100 | 92.6 | 86.5 |
| Process Efficiency | 48.3 | 52.2 | 55.8 |

The power consumption of each process is defined as the power required to compress the product streams up to the pressure of the feed air stream and therefore represents the work consumed in the separation process. The power consumptions are expressed relatively in Table 2 with that for the process according to EP-A-538 118 being 100.

It can be appreciated that the ratio of the air pressure, which (less pressure drop in the main heat exchanger) is the pressure at the bottom of the higher pressure rectifier, to the nitrogen pressure which (less pressure drop) is the pressure at the top of the lower pressure rectifier, is less in the operation of the plants according to FIGS. 1 and 2 of the accompanying drawings than in operation of the process according to EP-A-0 538 118. Accordingly, for a given operating pressure for the lower pressure column, the higher pressure column 12 of the plants shown in FIGS. 1 and 2 of the accompanying drawings operates at lower pressure than the corresponding column in a process according to EP-A-0 538 118. This can be a considerable advantage as manufacturing difficulties tend to increase with the pressure at which the column is required to operate. Moreover, the advantages in power consumption are manifest. These advantages outweigh the reduced recovery of oxygen in the process according to the invention.

Figure 4:
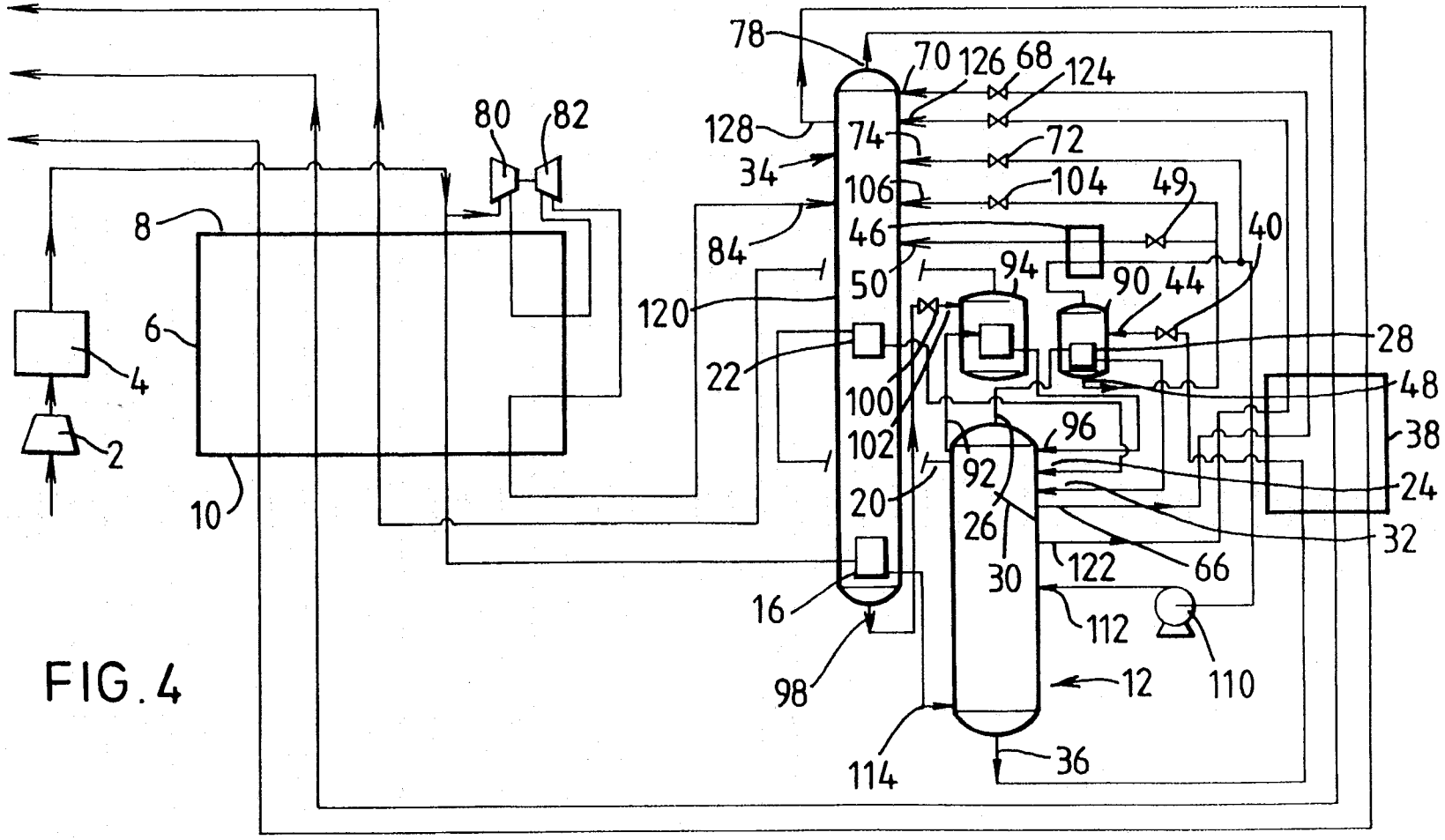
FIGS. 4 to 8 are schematic flow diagrams of further air separation plants according to the invention.

Various modifications and variations be made to the plant shown in FIGS. 1 and 2. One example of a modified form of the plant shown in FIG. 2 is illustrated by FIG. 4. Like parts occurring in FIGS. 2 and 4 are indicated by the same reference numerals. Since the construction and operation of the plant shown in FIGS. 2 and 4 are largely the same as one another, only those features of the plant shown in FIG. 4 which do not have an exact counterpart in the plant shown in FIG. 2 will be described below.

In the plant shown in FIG. 4, the rectifier 34 comprises a single vessel 120 instead of the separate vessels 58 and 60 of the plant shown in FIG. 2. Accordingly, the reboiler 22 is located at an intermediate level within the vessel or column 120.

The plant shown in FIG. 4 produces an impure nitrogen product in addition to the relatively pure nitrogen product taken from the outlet 78 of the lower pressure rectifier 34. In order to produce this impure nitrogen product, an impure liquid nitrogen stream is withdrawn from the higher pressure rectifier 12 through an outlet 122, is sub-cooled by passage through a part of the heat exchanger 38 is reduced in pressure by passage through a throttling valve 124 and is introduced into the lower pressure rectifier 34 through an inlet 126. A gaseous nitrogen product is withdrawn from the lower pressure rectifier 34 through an outlet 128 and flows through the heat exchangers 38 and 6 cocurrently with the purer nitrogen product taken from the lower pressure rectifier 34 through its outlet 78.

In the plant shown in FIG. 4, the condenser-reboiler 28 is located within the vessel 90. The condenser-reboiler 28 may be of the thermo-siphon kind and be at least partially immersed in liquid within the vessel 90.

Figure 5:
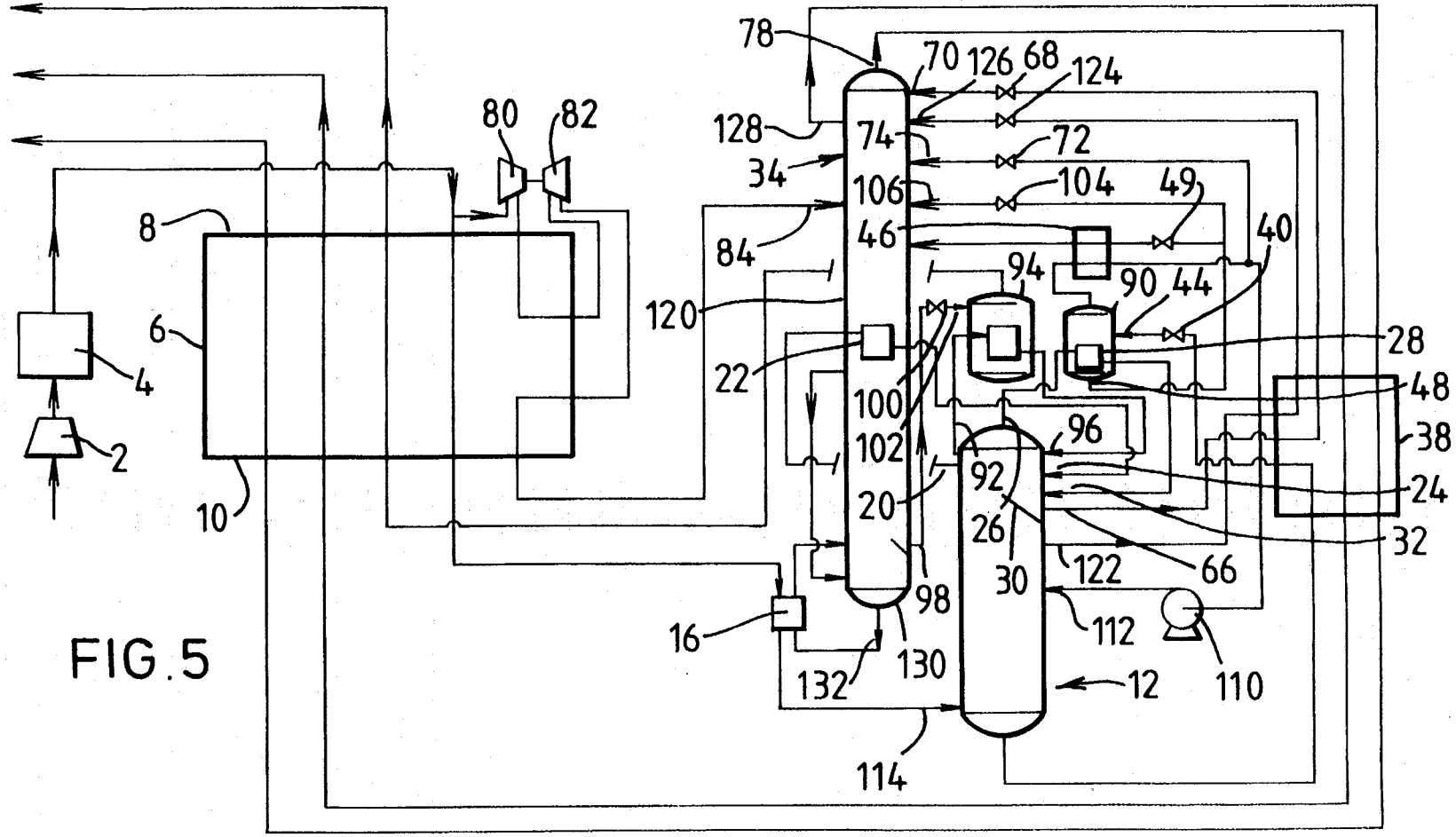

The plant shown in FIG. 5 is generally similar to that shown in FIG. 4 (and therefore like pans in the two Figures are identified by the same reference numerals) except that the reboiler 16 is located outside the lower pressure rectifier 34. In addition, in operation of the plant shown in FIG. 5, the composition of the liquid that is reboiled in the condenser-reboiler 16 is different from that of the impure liquid oxygen product that is reboiled in the condenser-reboiler 94. To achieve this difference in composition, the liquid that is vaporised in the condenser-reboiler 94 is taken directly (via the outlet 98) from the bottom of the liquid-vapour mass exchange means (not shown) in the lower pressure rectifier 34 without passing into the sump 130 of the rectifier 34. Some of the liquid leaving the bottom of the liquid-vapour mass exchange means in the lower pressure rectifier 34 is however upheld to pass under gravity into the sump 130 in which it is mixed with liquid relatively richer in nitrogen which is taken from a mass exchange level of the lower pressure rectification column 34 adjacent to but below the condenser-reboiler 22. The resulting mixture is withdrawn through an outlet 132 and flows through the boiling passages of the condenser-reboiler 16 and is thereby reboiled. The resulting vapour is reintroduced into the lower pressure rectifier 34 at a level below the liquid-vapour mass exchange means (not shown) located therein. By enriching in nitrogen the liquid being reboiled in the boiling passages of the condenser-reboiler 16, its boiling point is reduced. Accordingly, a complementary reduction in the temperature at which the air condenses in the condenser-reboiler 16 is made by reducing the pressure at which the air is supplied from the compressor 2 to the condenser-reboiler 16. As a result, it is possible to reduce the operating pressure of the higher pressure rectification column by about 0.5 bar without making any reduction in the operating pressure of the lower pressure rectifier 34.

Figure 6:
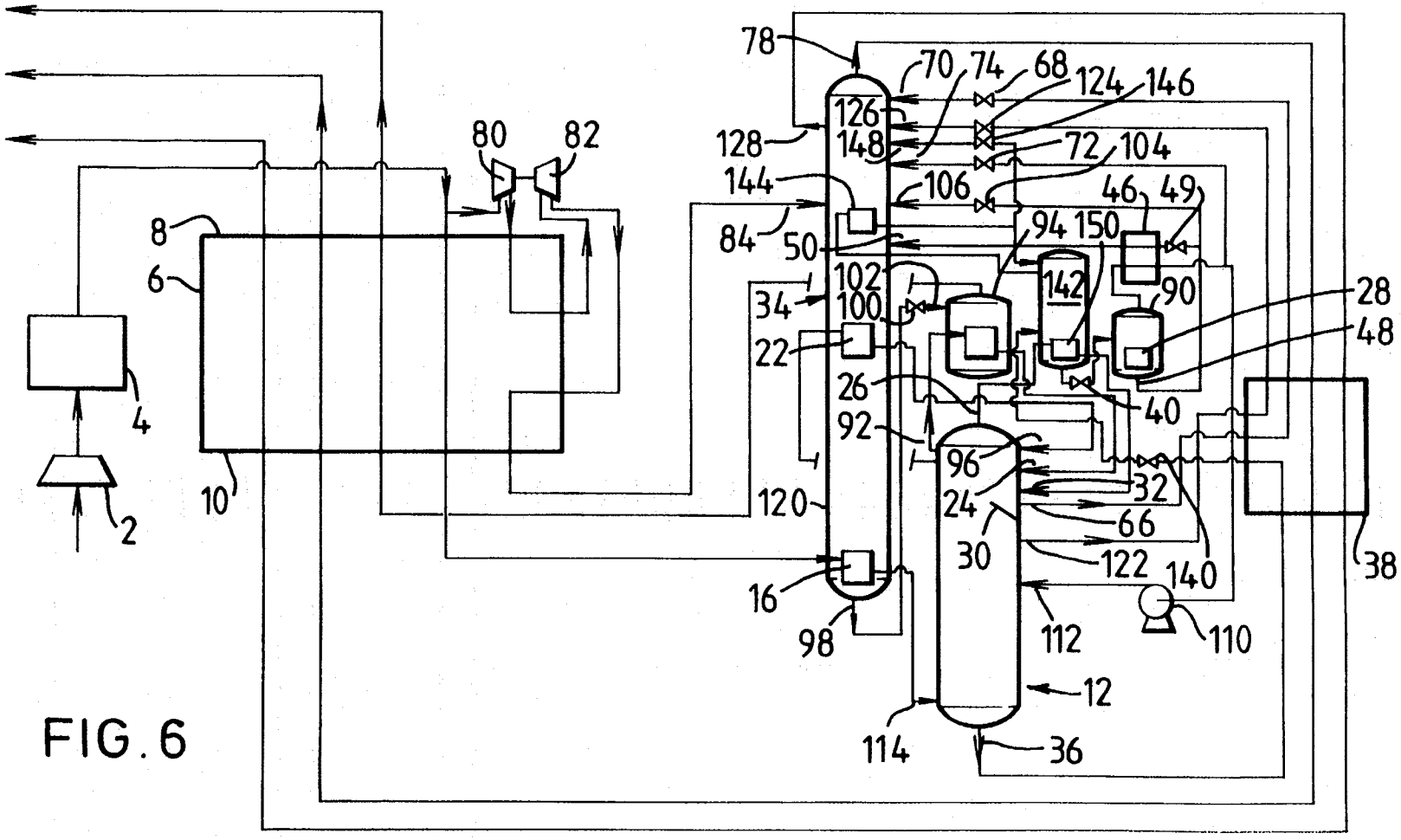

The plant shown in FIG. 6 of the drawings shows alternative modifications that may be made to the plant illustrated in FIG. 4 and again like parts in the two Figures are identified by the same reference numerals. In these modifications, the further enrichment the oxygen-enriched liquid is performed in two discrete stages, the downstream one of which corresponds to the reboiler-condenser 28 and vessel 90 of the plant shown in FIG. 4, and the upstream one of which has no counterpart in the plant shown in FIG. 4. Referring to FIG. 6, oxygen-enriched liquid is withdrawn from the higher pressure rectifier 12 through an outlet 36 and is sub-cooled by passage through the heat exchanger 38. The sub-cooled oxygen-enriched liquid is flashed through a pressure reducing valve 140 into an auxiliary rectification column 142 below the level of all liquid-vapour contact means (not shown) therein. The oxygen-enriched liquid is separated in the auxiliary rectification column 142 into a further-enriched liquid and nitrogen vapour. The nitrogen vapour that is so separated is not pure. Reflux for the auxiliary rectification column 142 is formed by withdrawing a stream of nitrogen vapour from the top of the column 142 and condensing it in a condenser-reboiler 144 located at an intermediate mass exchange level of the lower pressure rectifier 34 above that at which the condenser-reboiler 22 is situated. Condensation of the impure nitrogen vapour in the condenser-reboiler 144 is thus effected by indirect heat exchange with boiling liquid taken from mass exchange in the lower pressure rectifier 34. A part of the resulting condensate is returned to the top of the auxiliary rectification column 142 as reflux while another part of it is passed through a pressure reducing valve 146 and is introduced into the lower pressure rectifier 34 through an inlet 148. Reboil for the auxiliary rectification column 142 is provided by yet another condenser-reboiler 150 located in a sump of the column 142. The condenser-reboiler 150 is heated by nitrogen vapour taken from the top of the higher pressure rectifier 12 through the outlet 26. This nitrogen is condensed in the condenser-reboiler 150 and the resulting condensate is returned to the higher pressure rectifier 12 via the inlet 32 as liquid nitrogen reflux. Further enriched liquid is withdrawn from the bottom of the auxiliary rectification column 142 and is flashed through a pressure reducing valve 40 and is introduced into the condenser-reboiler 28 located within the vessel 90. The operation of this condenser-reboiler 28 is substantially as described with reference to FIG. 2.

In one example of the operation of the plant shown in FIG. 6 of the drawings, the higher pressure rectification column 12 has an operating pressure of 10.2 bar, the auxiliary rectification column 142 an operating pressure of 7.8 bar and the vessel 90 has an outlet pressure of 6.5 bar. The lower pressure rectifier 34 has an operating pressure of about 4.5 bar and the impure liquid oxygen product is vaporised at about 3.2 bar.

Figure 7:
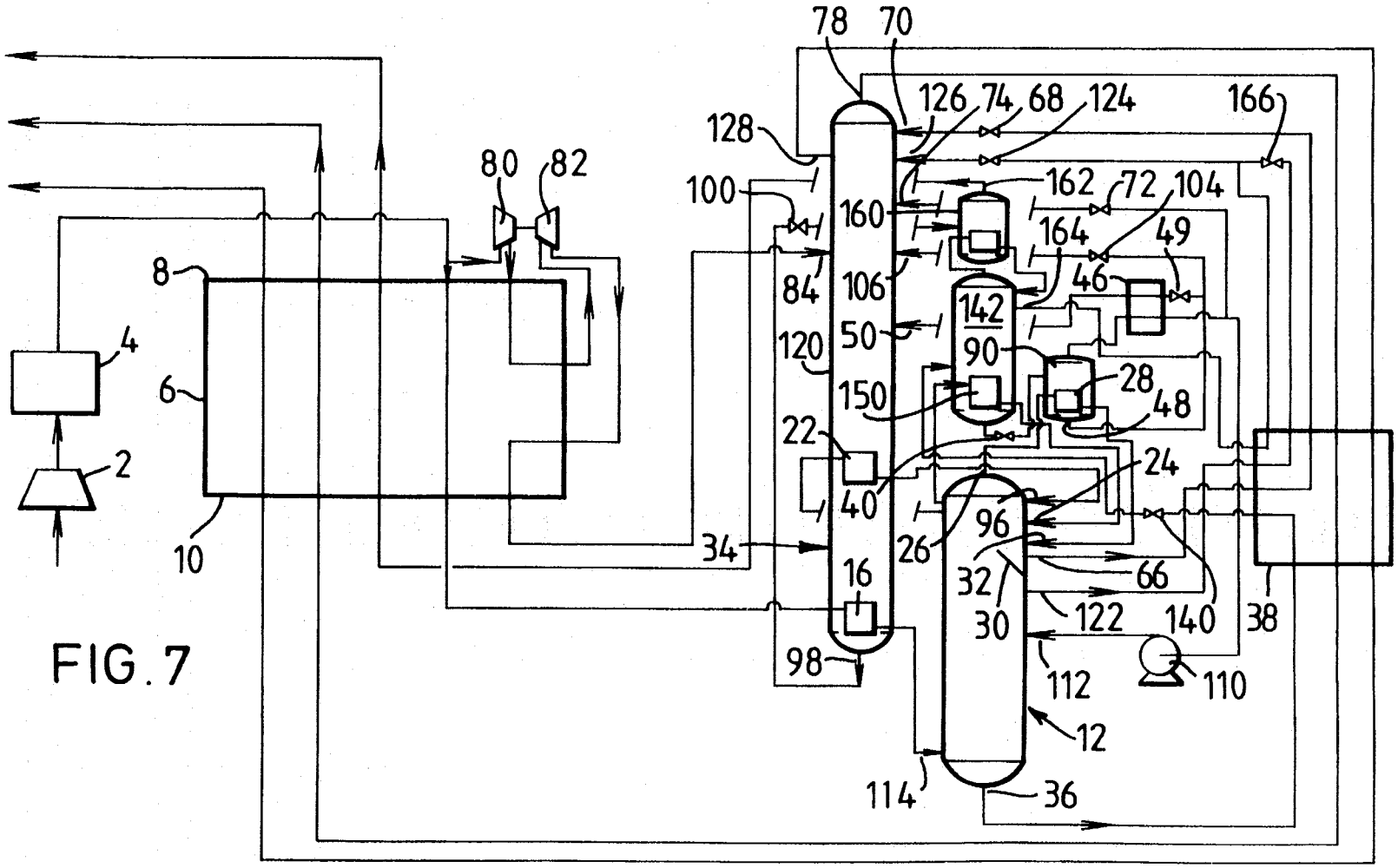

In FIG. 7 of the accompanying drawings there is shown a plant which can be viewed as a modification to that shown in FIG. 6 and like parts in the two Figures are identified by the same reference numerals. In this modification, the vaporisation of the impure liquid oxygen product is employed to condense nitrogen vapour taken from the top of auxiliary rectification column 142. Thus a single, condenser-reboiler used in the plant shown in FIG. 7 to take the place of the condenser-reboilers 94 and 144 of the plant shown in FIG. 6. Referring to FIG. 7, impure liquid oxygen product is withdrawn from the bottom of the lower pressure rectifier 34 through the outlet 98 and is reduced in pressure by passage through the throttling valve 100. The resulting fluid stream is introduced into a condenser-reboiler 160 and is totally vaporised therein. The resulting vapour is withdrawn from the condenser-reboiler 160 through an outlet 162 and is warmed to ambient temperature by passage through the main heat exchanger 6. Heating for the condenser-reboiler 160 is provided by nitrogen taken from the top of the auxiliary column 142. The nitrogen condenses and the resulting condensate is returned to the top of the auxiliary column 142 and serves as reflux for that column. Impure liquid nitrogen is withdrawn from the top of the column 142 through an outlet 164, is sub-cooled in the heat exchanger 38, and is merged with the impure liquid nitrogen withdrawn from the column 122 downstream of a pressure reducing valve 166. In other respects and construction of operation of the plant shown in FIG. 7 is wholly analogous to FIG. 6.

In a typical example of the operation of the plant shown in FIG. 7, the higher pressure rectification column 12 may have an operating pressure of approximately 13 bar, the lower pressure rectifier an operating pressure of about 6 bar, the auxiliary column 142 an operating pressure of 10 bar, the condenser-reboiler 148 an operating pressure of about 8 bar and the condenser-reboiler 160 an operating pressure (in its boiling passages) of approximately 2.6 bar.

Figure 8:
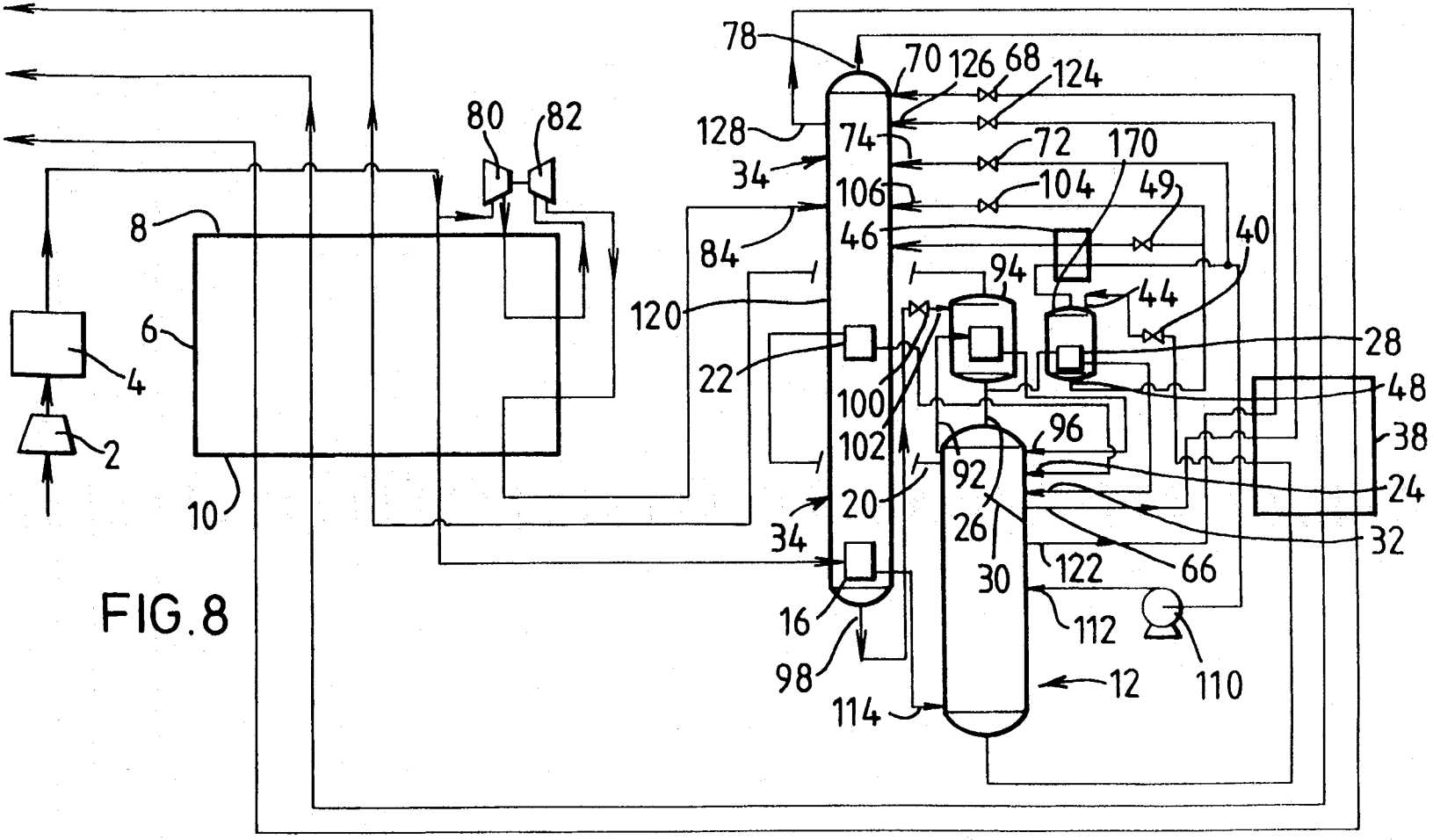

In FIG. 8 there is shown a modification to the plant illustrated in FIG. 4. In this modification, the vessel 90 is replaced by a small rectification column 170 typically having a few trays (not shown) located above the condenser-reboiler 28 which is located in the bottom of the column 170. The oxygen-enriched liquid stream is introduced into the column 170 through the inlet 44 at a level above all the liquid-vapour contact trays therein. This liquid descends the column 170 flowing from tray to tray. It comes into contact with vapour boiled in the reboiler-condenser 28. Mass exchange takes place between the rising vapour and the descending liquid with the result that the further enrichment in oxygen of the liquid is enhanced. In other respects, the construction and operation of the plant shown in FIG. 8 is wholly analogous to the plant shown in FIG. 4.

I claim:

1. A method of separating air, comprising the steps of:

a) separating pre-cooled and purified air in a higher pressure rectifier into oxygen-enriched liquid and nitrogen vapour;

b) separating a stream of the oxygen-enriched liquid at a pressure between the pressure at the top of the higher pressure rectifier and that at the bottom of a lower pressure rectifier so as to form a liquid further enriched in oxygen and an intermediate vapour;

c) separating a stream of the further-enriched liquid in the lower pressure rectifier into oxygen and nitrogen; and d) providing liquid nitrogen reflux for the higher and lower pressure rectifiers, part of the liquid nitrogen reflux being formed by condensing a stream of said nitrogen vapour by indirect heat exchange with liquid from an intermediate mass transfer region of the lower pressure rectifier.

2. The method as claimed in claim 1 in which the intermediate vapour is condensed by indirect heat exchange with a stream of said further-enriched liquid which has been reduced in pressure upstream of the heat exchange; and the stream of further-enriched liquid is partially vaporised by the heat exchange with the intermediate vapour and the partially vaporised further-enriched liquid is introduced into the lower pressure rectifier.

3. The method as claimed in claim 1, in which the intermediate vapour is condensed by indirect heat exchange with liquid taken from an intermediate mass transfer region of the lower pressure rectifier.

4. The method as claimed in claim 1, in which the separation in the step (b) is performed by rectification in a further rectifier.

5. The method as claimed in claim 4, in which the stream of oxygen-enriched liquid is introduced below all vapour-liquid mass exchange means in the further rectifier and the intermediate vapour produced in the further rectifier is nitrogen.

6. The method as claimed in claim 5, in which one part of a condensed intermediate vapour is used as reflux in the further rectifier, and another part of the condensed intermediate vapour is used as reflux in the lower pressure rectifier.

7. The method as claimed in claim 4, in which a portion of liquid in the bottom of the further rectifier or a portion of the feed to the further rectifier is reboiled.

8. The method as claimed in claim 7, in which the reboiling is performed by indirect heat exchange with a stream of nitrogen vapour from the higher pressure rectifier, the stream of nitrogen vapour thereby being condensed.

9. The method as claimed in claim 8, in which the condensed nitrogen vapour formed in the reboiling of the further-enriched liquid is employed as reflux in the higher pressure rectification column.

10. The method as claimed in claim 1, in which the said step (b) is performed by flashing the stream of oxygen-enriched liquid to form a liquid-vapour mixture at said pressure between the pressure at the top of the higher pressure rectifier and that at the bottom of the lower pressure rectifier, and separating the resulting liquid-vapour mixture into liquid and vapour phases so as to form the further-enriched liquid and the intermediate vapour, and a part of the further-enriched liquid is reboiled so as to enhance the rate of formation of the intermediate vapour.

11. The method as claimed in claim 10, in which the intermediate vapour is condensed and the resulting condensate is returned to the higher pressure rectifier.

12. The method as claimed in claim 10, in which a part of the further-enriched liquid is reboiled so as to enhance the rate of formation of the intermediate vapour.

13. The method as claimed in claim 1, in which reboil for the lower pressure rectifier is provided by indirect heat exchange with a stream of pre-cooled and purified feed air, whereby the feed air stream is at least partially condensed.

14. An apparatus for separating air, comprising:

a) a higher pressure rectifier for separating pre-cooled and purified air into oxygen-enriched liquid and nitrogen vapour;

b) a lower pressure rectifier for producing oxygen and nitrogen;

c) means for separating a stream of the oxygen-enriched liquid at a pressure between the pressure at the top of the higher pressure rectifier and that at the bottom of the lower pressure rectifier so as to form a liquid further enriched in oxygen and an intermediate vapour;

d) means for introducing a stream of the further-enriched liquid into the lower pressure rectifier for separation into oxygen and nitrogen; and e) means for providing liquid nitrogen reflux for the higher and lower pressure rectifiers including a condenser for indirectly heat exchanging a stream of said nitrogen vapour with liquid from an intermediate mass transfer region of the lower pressure rectifier.

15. The apparatus as claimed in claim 14, in which said separating means comprises a further rectifier;

16. The apparatus as claimed in claim 15, in which the further rectifier has a condenser and a reboiler associated therewith.

17. The apparatus as claimed in claimed in claim 14, in which said separating means comprises a pressure reduction valve and a phase separator on the downstream side of the pressure reduction valve.

18. The apparatus as claimed in claim 17, additionally including a reboiler upstream of or in the phase separator.

* * * * *